United States Patent [19]

Broyles, III

[11] Patent Number: 4,848,517

[45] Date of Patent: Jul. 18, 1989

[54] TANK SAFETY LADDER

[76] Inventor: Luda E. Broyles, III, R.D. 2, Box 83, Elverson, Pa. 19520

[21] Appl. No.: 181,535

[22] Filed: Apr. 14, 1988

[51] Int. Cl.[4] ..... E06C 5/24

[52] U.S. Cl. ..... 182/83; 182/106; 182/115; 182/127

[58] Field of Search ..... 182/83, 106, 115, 228, 182/127, 90

[56] References Cited

U.S. PATENT DOCUMENTS

| | | | |
|---|---|---|---|
| 1,982,865 | 12/1934 | Gross | 182/106 |
| 2,226,489 | 12/1940 | Doherty | 182/90 |
| 2,318,492 | 8/1945 | Fenner . | |
| 2,726,123 | 12/1955 | Matthews | 182/106 |
| 3,112,010 | 11/1963 | Mihalik . | |
| 4,044,857 | 8/1977 | Guerette . | |
| 4,063,616 | 12/1977 | Gutierrez . | |
| 4,316,525 | 2/1982 | Gehlbach . | |
| 4,371,056 | 2/1983 | Anglade . | |
| 4,572,328 | 2/1986 | Benko | 182/113 |
| 4,603,758 | 8/1986 | Pettit . | |
| 4,679,657 | 7/1987 | Bennett | 182/113 |

FOREIGN PATENT DOCUMENTS

| | | | |
|---|---|---|---|
| 831945 | 5/1981 | U.S.S.R. | 182/115 |

*Primary Examiner*—Reinaldo P. Machado

*Attorney, Agent, or Firm*—Sixbey, Friedman, Leedom & Ferguson

[57] ABSTRACT

A safety ladder particularly suited for permitting access to the top of a tank having a convex exterior surface is provided. The ladder is designed to provide a safe vertical path between the ground and a flat work platform attached to the ladder at the top of the tank. The safety of the tank ladder is enhanced by providing a pair of smooth, continuous, unbroken vertical handrails spaced outwardly of the ladder along which the tank operator can slide his hands without removing them from the rails from the top to the bottom of the ladder. Safety steps include spaced rung sections secured to vertical supports to define a central opening through which spilled liquids, rain or snow may drop instead of accumulating on the surface of the step as in prior art ladder steps. A central reinforcing bar extends between the rung sections to strengthen the steps. A flat platform is attached to the top of the ladder to form the top step of the ladder and to provide a safe work space at the curved top of the tank. Optional sidewalls and guardrails may be provided to enhance the safety of the platform.

15 Claims, 2 Drawing Sheets

TANK SAFETY LADDER

TECHNICAL FIELD

The present invention relates generally to safety ladders and specifically to a safety ladder for use with a tank having a convex exterior configuration.

BACKGROUND ART

Many of this country's fluid or liquid products are transported from one location to another in bulk. The preferred method of transporting such fluids is in a large tank hauled by a bulk carrier. The bulk carrier typically employs a motor-driven tractor or power unit that is coupled to a trailer on which is mounted the tank. Tanks customarily used for this purpose have either a circular cross-sectional configuration or an ovoid cross-sectional configuration, with the height being less than the width so that the exterior tank surface is convexly curved from the top to the bottom. The fill inlet, fill line attachment, valves, gauges, tank controls and other structures to which the tank operator or driver must have access in order to fill the tank with liquid are usually located on the topmost surface of the tank. This topmost surface of a typical tank trailer may be well over twenty feet from the ground. Consequently, some type of structure must be provided to allow the tank operator to have access to the top of the tank to fill the tank and to adjust or repair the controls when required. A tank container of this same general configuration designed either to be carried on a railroad car rather than by tractor-trailer or to be stationary poses the same kinds of problems regarding access to the fill inlet, fill line attachments, valves and similar structures.

Once the tank operator can reach the fill openings and equipment, filling the tank with the tens or hundreds of thousands gallons of the liquid or flowable commodity to be carried presents additional problems. Not only does the typical tank configuration fail to provide a flat surface on which the operator can stand, but the smooth metal exterior surface can be treacherous. These surfaces, which may be highly polished and almost mirror-like on tanks designed to carry milk and other potable and edible fluids, are slippery when dry. Even a small liquid spill can increase significantly the slipperiness of such a surface. Consequently, unless the tank operator is provided a safe, flat structure on which to stand while filling the tank or working on the controls, his safety could be seriously compromised. Since such structures are typically not provided, filling a trailer or railcar tank can be rather hazardous, and accidents are not uncommon.

In addition, filling operations are very often accompanied by some spillage of the tank contents, either from overfilling of the tank or as a result of leakage from the fill hose. In such instances, the tank operator may find these contents on his shoes or boots as well as on the tank exterior. His safety is further jeopardized by the lack of a nonskid work surface that will drain away spilled liquids. Ladders or other structures that provide access to the top of the tank which accumulate, rather than drain away, spilled liquid also pose safety hazards. When a spill has been particularly bad, moveover, any contact between the operator's wet footgear and a structure such as a ladder rung could be dangerous. In this situation, some alternate means for the operator to descend safely from the top of the tank to the ground would be highly desirable.

Structures currently available for providing access between the ground and the tops of large tank carriers and stationary tanks fall significantly short of these objectives. U.S. Pat. No. 4,371,056 to Anglade discloses one of these structures, an upright ladder mounted on the rear of a tank truck to provide access to a "catwalk" located along the top of the tank. While the ladder shown in this patent provides a means of ascent and descent between the tank top and the ground, its utility is limited to those tanks having either a flat catwalk to enable the operator to reach the fill controls and equipment as described by Anglade or fill controls and equipment that are located at the extreme end of the tank. However, even assuming that either or both of these conditions was met, the Anglade ladder structure does not provide an alternate safe means of descent apart from using the ladder rungs in the event spillage of the tank's contents onto the operator's boots occurs.

It is also known to secure a ladder structure at one or more locations along the side of the tank to provide access to the top of the tank. These ladder structures, however, follow the generally convex configuration of the tank exterior surface and require the tank operator to ascend and descend along this convexly curved surface. Descent, in particular, can be quite hazardous if attempted quickly or when the ladder rungs are slippery from spillage of the tank contents.

Access to the top of the tank may also be provided by a portable ladder that is not permanently securd to the tank, such as one of the types of ladders shown in U.S. Pat. No. 3,112,010 to Mihalik, 4,044,857 to Guerette and 4,063,616 to Gutierrez. These ladders, however, are somewhat bulky to store and may be inconvenient to use, since their inclined angle requires the base of the ladder to be located some distance from the tank. A major disadvantage of such ladders, however, is that they provide access to the top of the tank only when the tank carrier is in a location where the ladder can be stored, such as in a garage or railyard. If access to the top of the tank is required for any reason when the tank carrier is on the road or away from the ladder storage location, the operator cannot get to the top of the tank unless a substitute for the ladder can be obtained.

The prior art, therfore, fails to disclose a substantially vertical ladder or similar structure that can be permanently attached to the convex exterior surface of a tank to provide quick, safe and easy ascent and descent between the ground and the top of the tank under adverse weather and working conditions. The prior art further fails to disclose a safety ladder for attachment to the convex exterior surface of a tank wherein the uppermost step of the ladder forms a safe, flat work surface at the topmost surface of the tank and the remaining steps are specifically designed to stay substantially free from liquid and nonslippery in wet conditions.

DISCLOSURE OF THE INVENTION

It is a primary object of the present invention to overcome the deficiencies of the prior art as discussed above and to provide a substantially vertical safety ladder for attachment to the convex exterior surface of a tank to facilitate ascent and descent between the top of the tank and the ground.

It is another object of the present invention to provide a substantially vertical safety ladder for attachment to the convex exterior surface of a tank, wherein the uppermost step portion of the ladder forms a safety platform from which the tank operator may have access to controls and equipment at the top of the tank.

It is yet another object of the present invention to provide a safety ladder for a tank having a convex exterior surface that may be ascended and descended safely under a wide range of adverse environmental conditions.

It is still another object of the present invention to provide a combined safety ladder and flat work platform for a tank having a convex exterior surface wherein the ladder and platform can be safely used even in the event of spillage of the tank contents during filling and other operations.

It is a further object of the present invention to provide a substantially vertical safety ladder for a tank having a convex exterior surface wherein the ladder includes structure that allows the ladder to be descended safely and quickly in one of two alternate ways.

It is a still further object of the present invention to provide a safety ladder for use in wet environments including steps which do not become slippery and can firmly support heavy weights.

In accordance with the aforesaid objects, a safety ladder is provided for attachment in a substantially vertical orientation tangent to the convex exterior surface of a tank having a substantially circular or ovoid cross-sectional configuration. The safety ladder of the present invention, which provides a path of ascent and descent between the ground and the top of the tank, includes a pair of spaced parallel vertical support means extending from the ground to the top of the tank, a plurality of safety step means spaced at intervals between the vertical support means and a pair of smooth, unbroken handrail means extending along the ladder parallel to the vertical support means. The uppermost extent of the ladder includes platform means forming the top step of the ladder to provide a safe, flat work surface at the top of the tank. Guardrail means and containment means may be provided along the platform means to enhance further the safety of the platform means.

Other objects and advantages will be apparent to those skilled in the art from the following description, claims and drawings.

BEST MODE FOR CARRYING OUT THE INVENTION

Figure 1:
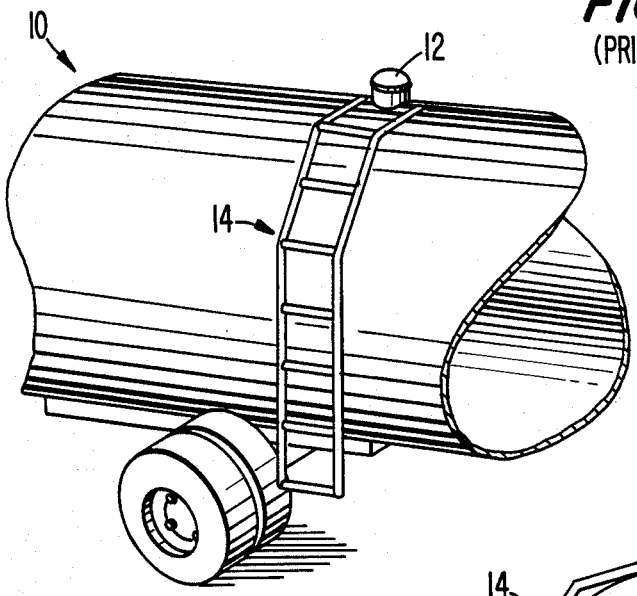
FIG. 1. (PRIOR ART)
FIG. 1 illustrates on prior art ladder for a curved tank in perspective view.
Figure 2:
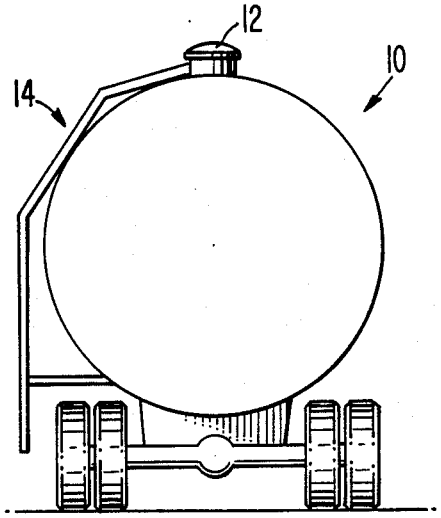
FIG. 2. (PRIOR ART)
FIG. 2 illustrates another prior art ladder for a curved tank in end view.

One of the major hazards encountered by tank truck or tank car operators, drivers and workers who must fill the tank with its fluid contents or perform other work at the top of the tank is the unsafe ladder structure currently provided for access between the ground and tank top. Available ladder structures do not permit the tank operator a safe ascent and descent under all the conditions likely to be encountered during filling of the tank and other operations. These ladder structures are particularly hazardous when the tank contents have spilled or overflowed and in adverse weather conditions. FIGS. 1 and 2 illustrate ladder structures typical of the prior art.

The configuration of a tank 10 of the type that is hauled over the highways by a tractor-trailer rig (not shown) or on railroad tracks by a railcar (not shown) is generally that of a cylinder having its longest axis parallel to the road. The cross-sectional configuration of the tank may be substantially circular, as shown in FIGS. 1 and 2, or somewhat ovoid. The fill inlet, valves, pressure gauges and other equipment that must be used by the tank operator in filling and checking the tank are located at some point along the top of the tank such as at 12 in FIGS. 1 and 2. The location of these structures often varies for different kinds of tanks and may be close to one end, as in FIGS. 2 or toward the center of the tank, as in FIG. 1. However, wherever the location of the fill inlet and associated structures, the prior art solution to providing access to them has been to mount a ladder 14 along the outer circumference of the tank 10 that may be curved to conform substantially to the shape of the tank's convex exterior surface or that may be angular as shown in FIGS. 1 and 2. Such a ladder fails to provide a safe means of ascending and descending the tank to reach the top for several reasons.

Because the ladder is curved or sharply angled, it is very easy to lose one's balance, even under good weather and working conditions. Under the conditions often encountered by tank drivers and workers, such a ladder becomes treacherous. It is quite common during fill operations for the liquid contents of the tank to be spilled. Hoses or connectors may leak or a shut-off valve may not promptly shut off the flow of liquid to the tank, causing this liquid to run or slosh over the sides of the tank, the worker's shoes and the ladder. The liquids often carried by tank, truck or car may include fluids as diverse as water, milk, diesel fuel, organic solvents and corn syrup. Therefore, spillage creates a wet, slippery and possibly sticky tank surface. In addition, the worker's shoes and the ladder steps may become covered with spilled liquid. There is no safe, slip-free place on which the worker can stand to deal with a leak or faulty valve on the prior art ladders without danger of slipping and falling.

Moveover, there is no structure on the prior art ladders for the worker to hold onto to prevent a fall or to grab onto to break his fall in the event that he slips, nor are there steps designed to be slip-free in the event of a spill. Further, the curved or sharply angled shape of these ladders may even increase the likelihood of a fall because the curved shape would tend to direct a worker who has fallen to slide along a path tangent to the curve directly to the ground. Depending where on the curved or angled ladder this occurred, the worker could fall a substantial distance to the ground. Consequently, the safety of tank drivers and operators has been seriously compromised by the prior art tank ladders.

Figure 3:
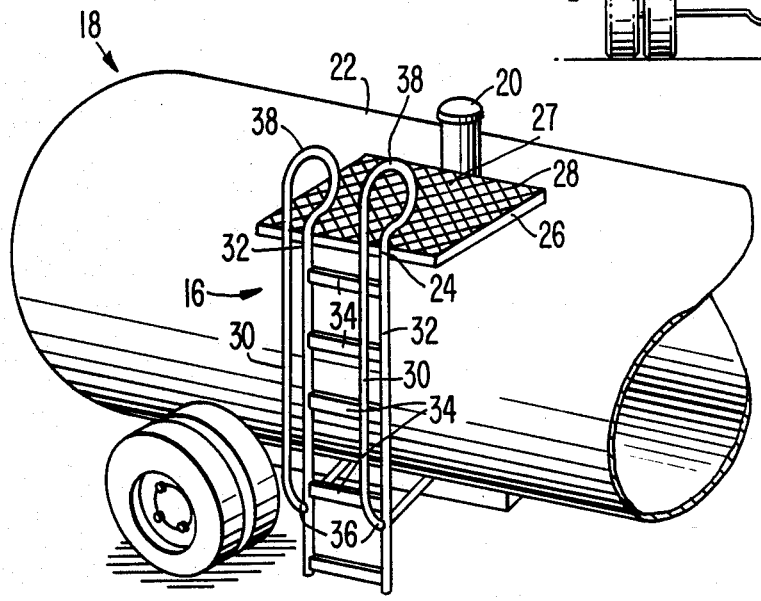
FIG. 3 illustrates, in perspective view, one embodiment of a safety ladder constructed according to the present invention.
Figures 4, 5:
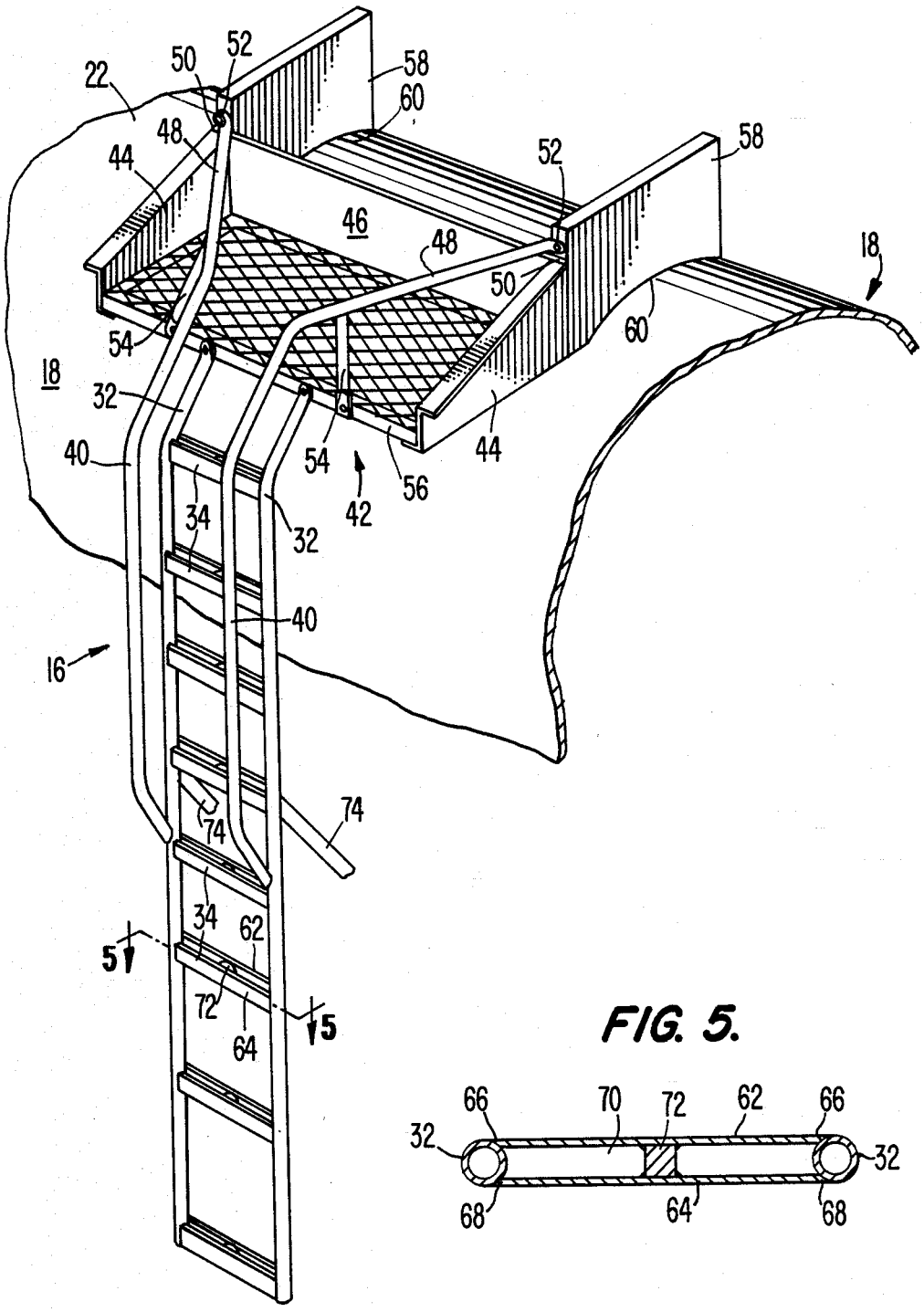
FIG. 4 illustrates, in perspective view, a second embodiment of the safety ladder of the present invention.
FIG. 5 illustrates, in cross-sectional view, a step of the safety ladder of the present invention.

In contrast, the present invention provides a ladder structure whereby a tank car driver or operator can safely ascend from the ground up the curved side of the tank to the top, stand firmly and securely on the top of the tank while filling the tank or performing maintenance operations, and then safely descend from the tank top back to the ground under even the most adverse weather and environmental conditions. Moreover, the present invention significantly minimizes the likelihood of slips and falls by the persons using it. FIGS. 3 through 5 illustrate the features of the present invention that interact to produce this exceptionally safe tank ladder.

FIG. 3 illustrates, in perspective view, one embodiment of the present safety ladder 16 mounted in place along one side of a tank 18, such as would be hauled by a tractor-trailer rig (not shown). The tank fill inlet 20 and associated structures (not shown) are located on the top surface 22 of the tank. The present safety ladder 16, in distinct contrast to the prior art ladders of FIGS. 1 and 2, is not shaped to correspond to the convex contour of the tank 18, but is vertical and substantially perpendicular to the ground along its entire height. The top end 24 of the ladder 16 is secured to a platform 26 that is positioned adjacent to the top surface 22 of the tank 18 to form the top step of the ladder. Platform 26, which is substantially perpendicular to the ladder 16 and parallel to the ground, also forms a flat surface on which the tank car driver or operator can stand while filling the tank or performing other operations or maintenance on the fill inlet 20 and related structutes. Therefore, platform 26 should be positioned sufficiently close to these structures to provide a convenient work surface. The floor 28 of the platform 26 should preferably be formed of a heavy metal mesh or other material in a latticetype pattern like that shown in FIG. 3. This floor material should preferably have a large number of perforations or openings 27 so that any liquid spilled during filling of the tank can readily drain through the platform and will not accumulate and form puddles. In addition, the working surface of floor 28 of platform 26 may be treated with or include an abrasive material (not shown) to make it rough and nonskid rather than smooth. Although substantially all of the liquid that has spilled or rain that has fallen on platform 26 will drain through the openings 27 in floor 28, the additional provision of a rough surface that contacts the workers' boots further minimizes the likelihood that the worker will slip on the platform and fall.

Platform 26 is shown in FIG. 3 to have a substantially rectangular shape and to extend only slightly beyond the width of the ladder 16. However, the platform 26 can be as large as desired, as long as it serves as the top step of the ladder and provides a flat work surface along the top surface 22 of the tank 18 adjacent to the fill inlet 20. Platform 26 may, in addition, be constructed to be sufficiently large to accommodate the number of workers required to fill the tank and perform whatever additional operations may be necessary at that location. The platform 26 may be the simple structure shown in FIG. 3, or it may include additional safety features as discussed in detail hereinbelow.

One of the major drawbacks of the prior art tank ladders has been the lack of any kind of separate handrails or hand grips. As a result, the tank operator has been required to use the ladder rung supports and steps or rungs of the ladder to assist him in ascending or descending the tank. This lack of a handrail can create a particularly unsafe condition during descent. If the operator's foot slips, there is nothing to grab or hold onto that would break his fall and help his descent to the ground. If he grabs the rung above him, he may be left hanging from the tank because of the curvature or angle of the ladder. If he grabs the ladder rung supports, he may slide downwardly until his descent is stopped when his hands hit the next ladder rung attached to the rung supports, which could be quite painful and lead to injury. The present invention provides a pair of spaced handrails 30 parallel to the vertical ladder step or rung supports 32 and spaced outwardly of supports 32 away from the side of the tank 18. The handrails 30 extend along substantially the entire length of the supports 32 so that the tank operator or worker can hold onto them during the entire ascent from the ground to the top of the tank, which may be twenty or more feet above the ground. Additionally, the handrails 32 are continuous and unbroken by supporting structure so that the worker does not have to remove his hands from them between the bottom and the top of the ladder.

In addition to the safer ascent of ladder 16 permitted by the handrails 30, these handrails significantly increase the safety with which the present ladder may be descended. In wet weather or in the event of a spillage of the fluid tank contents which causes the steps or rungs 34 of the ladder 16 and the boots of the tank operator to become wet and slippery, handrails 30 may be used in at least two different ways to prevent the operator from falling. The handrails 30 provide convenient accessible grips on each side of the operator that may be lightly gripped during descent (or during ascent, as well) and, therefore, may be grabbed tightly if the operator slips and begins to fall.

The handrails 30 provide an additional safety feature not provided heretofore in conjunction with a tank ladder. As noted hereinabove, the ladder 16 is positioned substantially perpendicular to the surface of the ground and therefore, extends vertically straight up to the top of the tank rather than assuming the curved or angular tank configuration of prior art tank ladders. Each handrail 30 is attached to the ladder 16 only at its lowermost extent 36. In the embodiment shown in FIG. 3, the uppermost extent of each handrail 30 extends above the floor 28 of platform 26 to form a curved handgrip 38 which may bend toward platform 26 as shown to connect to a step support 32. The curved configuration of handgrips 38 shown in FIG. 3 provides a convenient gripping surface during ascent and descent of the ladder and for use while working on platform 26. Other handgrip configurations could be employed as well, however, If the tank operator slips and falls while descending the ladder, he may use the handrails 30 as poles to slide down and, thus, to assist him in reaching the ground. He may either continue to hold onto both handrails 30, one with each hand, and slide down along both rails to the ground or hold onto one handrail with both hands and slide down that rail to the ground. Either method provides an alternate safe descent to the ground apart from the ladder if the tank operator loses his footing.

This is in distinct contrast to the situation the tank operator finds himself in when his foot has slipped on a prior art tank ladder that does not include a smooth and continuous handrail like handrail 30 of the present invention. Such ladders are not very safe because they provide no structure to break an operator's fall. First, these prior art ladders fail to provide structure in addition to the ladder rungs and supports that the falling operator can grab onto and, second, they fail to provide an alternate means separate from, yet associated with, the ladder for safely descending to the ground in the event of a slip or fall. In either event, the smooth, unbroken construction of the handrails 30 allows the tank operator to descent (and to ascend) the ladder 16 without letting go of the handrails 30.

FIG. 4 illustrates another embodiment of the tank safety ladder 16 of the present invention. In this embodiment, the handrails 40, while still providing a continuous smooth and unbroken gripping surface that extends along substantially the majority of the length of the ladder, also extend upwardly over the top of the platform 42 and are secured to the platform to provide an additional safety feature. Platform 42 of this embodiment is substantially wider side-to-side than is platform 26 in FIG. 3. Platform sidewalls 44 and back wall 46 enhance the safety of a tank operator using platform 42. These walls provide additional security for the operator and, in addition, help to confine tools and other equipment to the top of the platform 42. Handrails 40 include guardrail extensions 48 that extend toward the outer top corners 50 of the platform back wall 46 and are secured thereto by bolts 52 or the like. Vertical braces 54 may be provided as shown in FIG. 4 to secure guardrail extensions 48 to the front edge 56 of platform 40, thereby further stabilizing these structures. The combination of sidewalls 44, back wall 46, guardrail extensions 48 and braces 54 makes platform 40 an exceptionally safe work surface.

The stability of platform 40 is further enhanced by stabilizing walls 58 which extend over the top 22 of the tank 18 and may enclose the tank fill inlet, valves, gauges and related equipment (not shown). The stabilizing walls 58 include a concave bottom surface 60 which corresponds to the convex surface of the top 22 of the tank 18 to provide a snug fit between the stabilizing walls 58 and the tank. The platform 42 is preferably secured to the tank 18 by welding, brazing or the like so that the concave bottom surfaces 60 of stabilizing walls 58 are properly seated in place on the top surface 22 of the tank 18.

The configuration of the steps or rungs 34 of the present tank ladder further increases the safety of this ladder. FIG. 5 clearly illustrates, in top cross-sectional view, the construction of steps 34. Each step 34 includes two spaced rung sections 62 and 64 which are substantially rectangular in shape, with the longer dimension of the rectangle extending between the vertical step supports 32. Rung section 62 is permanently secured to support 32 along the ends 66, and rung section 64 is permanently secured to support 32 along the ends 68. Rung section 62 is spaced away from rung section 64 a distance approximately equal to the front-to-back thickness or diameter of each vertical support 32 to define a central opening 70. a central bar 72 extends between and is secured to both rung sections 62 and 64 to provide additional reinforcement. This spaced rung construction provides better support than the single bar typically found on tank ladders because it contacts more of the foot. Moreover, the space between the contact surface of each rectangular rung section 62 and 64 allows oil, grease, and other liquids that were spilled or are on the tank operator's boots to drop between the rung sections. As a result, the foot contact surface along the tops of each rung section is not slippery. The spaced arrangement of the ladder steps 34 of the present invention also prevents the accumulation of water, ice and snow during bad weather. This ladder arrangement, therefore, provides significantly safer footing for the use of the ladder than do prior art ladder steps.

Support brackets, such as the pair of support brackets 74 shown in FIG. 4, may be provided to provide additional support to the lowermost end of ladder 16 and to attach the ladder to the side of the tank.

The present tank ladder is preferably constructed from a strong, durable metal, such as steel or the like. The handrails 30 and 40 and step or rung supports 32 may be formed of metal tubing. Handrails 30 and 40 are preferably circular in cross-sectional configuration to provide a comfortable gripping surface. Vertical step supports 32 and central reinforcing bars 72 may be either circular or rectangular in cross-sectional configuration. Rung sections 62 and 64 are preferably flat plates of a thickness that will provide a top edge that is narrow enough to prevent the accumulation of liquids, but wide enough to support adequately the weight required to be supported by the ladder. The ladder sections may be attached to each other by any method that will create a strong, permanent bond, such as by welding, brazing and the like.

INDUSTRIAL APPLICABILITY

The safety ladder of the present invention will find its primary use and application in permanent installation to provide access between the ground and the top of a tank having a convex exterior surface and an ovoid or circular cross-sectional configuration. Tanks of this type are generally hauled along highways on trailors pulled by tractor units or along the rails on rail cars by locomotives. However, the safety ladder of the present invention could also be employed to provide access to the tops of stationary tanks having convex exterior surfaces, such as might be found in large numbers in tank farms or singly in water and sewage treatment plants or other locations.

The novel step construction of the present invention could be used to enhance the safety of any ladder used either in outside environments subject to adverse weather conditions or in environments where liquids are likely to be spilled.

I claim:

1. A safety ladder and work platform for installation on the convex exterior surface of a tank to provide safe access between the ground along the side of the tank and the topmost surface of the tank, wherein said platform is positioned at the topmost surface of said tank and substantially tangent thereto to provide a flat work surface and to form the top step of said ladder, said work platform including a floor having openings therein to prevent the accumulation of liquid on said floor and containment means for defining a safe work area when the work platform is installed in place at the topmost surface of the tank, said containment means including a pair of opposed sidewalls located laterally with respect to the ladder and a back wall connecting said opposed side walls located opposite the ladder, and said ladder is secured perpendicularly to said platform to provide a substantially vertical path between the ground and said platform, said ladder including a pair of handrail means extending parallel to and outwardly from said ladder for forming a continuous unbroken handgrip between said platform and the bottom of said ladder, said handrail means extending from the top of said ladder to the back wall of said platform containment means, thereby forming a guardrail between the top of the ladder and the back of the platform.

2. A safety ladder and work platform for installation on the convex outside surface of a tank for a tank vehicle, to provide safe access between the top surface of the tank and a support surface beneath the vehicle, comprising:

platform means to be supported by the surface of the tank and adapted to extend over at least a portion of the top surface of the tank and outwardly from one side thereof in a plane substantially parallel to said support surface, a pair of spaced, substantially parallel step support means for supporting therebetween a plurality of spaced step means, said step support means having a free end and an upper extent secured to said platform means, said upper extent being spaced outwardly from said tank by said platform means when said platform means is supported on said tank, said step support means extending substantially perpendicular to said platform between said platform and said free end with said free end spaced above said support surface when said platform means is supported over the top surface of said tank, handrail means secured to said step support means to provide a continuous gripping surface from an upper handrail extremity spaced above said platform and inwardly of said step support means over said platform to a lower handrail extremity between said platform and the free end of said step support means, said handrail means extending from said lower handrail extremity outwardly of and substantially parallel to said step support means to provide a continuous, unbroken gripping surface to a point above said platform; and a plurality of step means supported by said step support means and secured at spaced intervals between said pair of step support means at right angles thereto, said step means each having a supportive, nonslippery bearing surface whereby the ladder may be ascended or descended.

3. A safety ladder and work platform as described in claim 1, wherein said step means includes a pair of substantially flat, rectangular rung sections, one of said pair of rung sections being secured between said vertical step support means along the portion thereof closest to said tank surface and the other of said pair of rung sections being secured between said vertical step support means along the portion thereof farthest away from said tank surface so that the flat surfaces of said pair of rectangular rung sections are parallel and spaced apart a distance corresponding to the front to back dimension of said vertical step support means to define a central opening between said rung sections.

4. A safety ladder as described in claim 3, wherein said step means further includes reinforcing means extending through said central opening secured to each of said rung sections to provide additional strength and stability to said step means.

5. The safety ladder and work platform described in claim 1, further including stabilization means for attaching said ladder and platform securely and stably to the topmost surface of said tank.

6. The safety ladder and work platform described in claim 1, wherein said ladder includes a plurality or spaced safety rung means, each of said rung means providing a wide, nonslippery step spaced at intervals along said ladder.

7. The safety ladder and work platform described in claim 6, wherein said safety rung means includes a pair of rung sections spaced to define a central opening therebetween and reinforcing means extending through said central opening between said rung sections for stabilizing said safety rung means.

8. The safety ladder and work platform of claim 1, wherein said handrail means include an elongate handrail for each of said pair of step support means, each said elongate handrail extending from the upper extent of a step support means upwardly and inwardly over said platform means, said handrail extending outwardly beyond said platform and step support means at the upper handrail extremity of said handrail means and downwardly to the lower handrail extremity of said handrail means, said handrail being connected to a step support means in the area of said lower extremity of said handrail means.

9. The safety ladder and work platform of claim 8, wherein said handrail is supported only at the connection to said step support means in the area of the lower extremity of said handrail means and at the upper extend of a step support means by the securement of said step support means to the platform.

10. The safety ladder and work platform of claim 9, wherein each said handrail is an extension of a step support means at the upper extent thereof.

11. A safety ladder and work platform for installation on the outside of a vehicle supported tank having a convex exterior surface to provide access between the top surface of the tank and a support surface beneath the vehicle, comprising:

platform means to be supported by the surface of the tank and including a work platform adapted to extend over at least a portion of the top surface of the tank and outwardly from one side thereof in a plane substantially parallel to said support surface, a ladder having an upper extremity attached to said work platform and a plurality of spaced rungs including an upper and lower rung, said ladder extending substantially perpendicular to said work platform in the area between said upper and lower rungs and terminating at a lower ladder extremity spaced above said support surface when said platform means is supported over the top surface of said tank, and handrail means adapted to provide a continuous gripping surface for said ladder and work platform extending in spaced relationship to both said ladder and said work platform, said handrail means including spaced handrails connected at one end to said ladder between said work platform and lower ladder extremity and extending from said connection with said ladder in spaced, substantially parallel relationship with said ladder to a first point spaced above said work platform, said handrail means extending from said first point above and over said work platform in spaced, substantially parallel relationship thereto, being connected to said ladder and work platform to provide an unbroken gripping surface between said first point and said connection with said ladder.

12. The safety ladder and work platform described in claim 11, wherein the work platform includes a floor having openings therein to prevent the accumulation of liquid on said floor.

13. The safety ladder and work platform described in claim 12, wherein the work platform includes containment means for defining a safe work area when the platform means is installed in place at the topmost surface of the tank.

14. The safety ladder and work platform described in claim 13, wherein said containment means includes a pair of opposed side walls located laterally with respect to the ladder and a back wall connecting said opposed side walls located opposite the ladder.

15. The safety ladder and work platform of claim 14, wherein said handrail means extends from said first point to the back wall of said platform containment means, thereby forming a continuous gripping surface from said back wall to the connection with said ladder.

* * * * *